US010828544B1

(12) United States Patent
Sharp

(10) Patent No.: US 10,828,544 B1
(45) Date of Patent: Nov. 10, 2020

(54) GOLF TOWEL WITH LIQUID CONTAINER

(71) Applicant: Thomas Sharp, Wantagh, NY (US)

(72) Inventor: Thomas Sharp, Wantagh, NY (US)

( * ) Notice: Subject to any disclaimer, the term of this patent is extended or adjusted under 35 U.S.C. 154(b) by 0 days.

(21) Appl. No.: 16/459,741

(22) Filed: Jul. 2, 2019

(51) Int. Cl.
*A63B 57/60* (2015.01)
*A63B 47/04* (2006.01)

(52) U.S. Cl.
CPC ..... *A63B 57/60* (2015.10); *A63B 47/04* (2013.01); *A63B 2225/68* (2013.01)

(58) Field of Classification Search
CPC ..... A47K 7/03; A47L 1/08; A47L 1/15; A47L 13/17; A47L 13/26; A63B 57/60
USPC ..... D6/208
See application file for complete search history.

(56) References Cited

U.S. PATENT DOCUMENTS

D433,590 S * 11/2000 Johnson ..... D6/608
6,206,596 B1 * 3/2001 Johnson ..... A47K 7/03 401/201
6,226,827 B1 5/2001 English, Jr.
D501,350 S * 2/2005 Kelly ..... D2/719
D531,443 S 11/2006 Sabeti
D538,095 S * 3/2007 Turner ..... D6/603
7,302,728 B2 * 12/2007 Kunz ..... A63B 47/04 15/104.93
7,484,262 B2 * 2/2009 Cotton ..... A63B 47/04 15/118
D613,544 S 4/2010 Salvaggio
D619,403 S 7/2010 Wingate
D661,534 S * 6/2012 Mullen ..... D6/608
9,402,454 B2 * 8/2016 Landy ..... B05D 7/24
9,802,092 B2 * 10/2017 Repasky, Jr. ..... B08B 1/006
9,931,002 B2 * 4/2018 Morgan ..... A47K 7/03
2007/0226934 A1 * 10/2007 Bohannon ..... A63B 57/60 15/209.1
2008/0034462 A1 * 2/2008 Ekelund ..... A41D 1/215 2/104
2009/0151105 A1 * 6/2009 Bohannon ..... A63B 57/60 15/210.1
2010/0077560 A1 * 4/2010 Cabullo ..... A63B 57/60 15/209.1
2013/0323457 A1 * 12/2013 Barringer ..... A47K 10/02 428/99
2015/0190689 A1 * 7/2015 Dastrup ..... A63B 47/04 15/210.1

(Continued)

FOREIGN PATENT DOCUMENTS

WO 2013177371 11/2013

*Primary Examiner* — David P Angwin
*Assistant Examiner* — Bradley S Oliver
(74) *Attorney, Agent, or Firm* — Kyle A. Fletcher, Esq.

(57) ABSTRACT

The golf towel with liquid container is configured for use during a game of golf. The game of golf further comprises the use of a golf ball. The golf towel with liquid container is configured for use in cleaning the golf ball. The golf towel with liquid container comprises a first textile, a second textile, an elastic webbing, a plurality of seams, a carabiner, and a bottle. The second textile and the elastic webbing form a pocket that attaches to the first textile. Each of the plurality of seams forms an attachment selected from the group consisting of: a) attaching the second textile to the first textile; and, b) attaching the elastic webbing to the second textile. The bottle is contained in the pocket formed by second textile and the elastic webbing. The carabiner anchors the golf towel with liquid container to an anchor point such as a golf bag.

19 Claims, 5 Drawing Sheets

(56) References Cited

U.S. PATENT DOCUMENTS

2015/0327746 A1* 11/2015 Winston ..... A61K 8/0208
15/227
2019/0313861 A1* 10/2019 Moore ..... A47K 7/03

* cited by examiner

GOLF TOWEL WITH LIQUID CONTAINER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of sports including ball games and devices for handling balls in a ball game, more specifically, a device for cleaning a ball used in a ball game. (A63B47/04)

SUMMARY OF INVENTION

The golf towel with liquid container is configured for use during a game of golf. The game of golf further comprises the use of a golf ball. The golf towel with liquid container is configured for use in cleaning the golf ball. The golf towel with liquid container comprises a first textile, a second textile, an elastic webbing, a plurality of seams, a carabiner, and a bottle. The second textile and the elastic webbing form a pocket that attaches to the first textile. Each of the plurality of seams forms an attachment selected from the group consisting of: a) attaching the second textile to the first textile; and, b) attaching the elastic webbing to the second textile. The bottle is contained in the pocket formed by second textile and the elastic webbing. The carabiner anchors the golf towel with liquid container to an anchor point such as a golf bag.

These together with additional objects, features and advantages of the golf towel with liquid container will be readily apparent to those of ordinary skill in the art upon reading the following detailed description of the presently preferred, but nonetheless illustrative, embodiments when taken in conjunction with the accompanying drawings.

In this respect, before explaining the current embodiments of the golf towel with liquid container in detail, it is to be understood that the golf towel with liquid container is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the golf towel with liquid container.

It is therefore important that the claims be regarded as including such equivalent construction insofar as they do not depart from the spirit and scope of the golf towel with liquid container. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
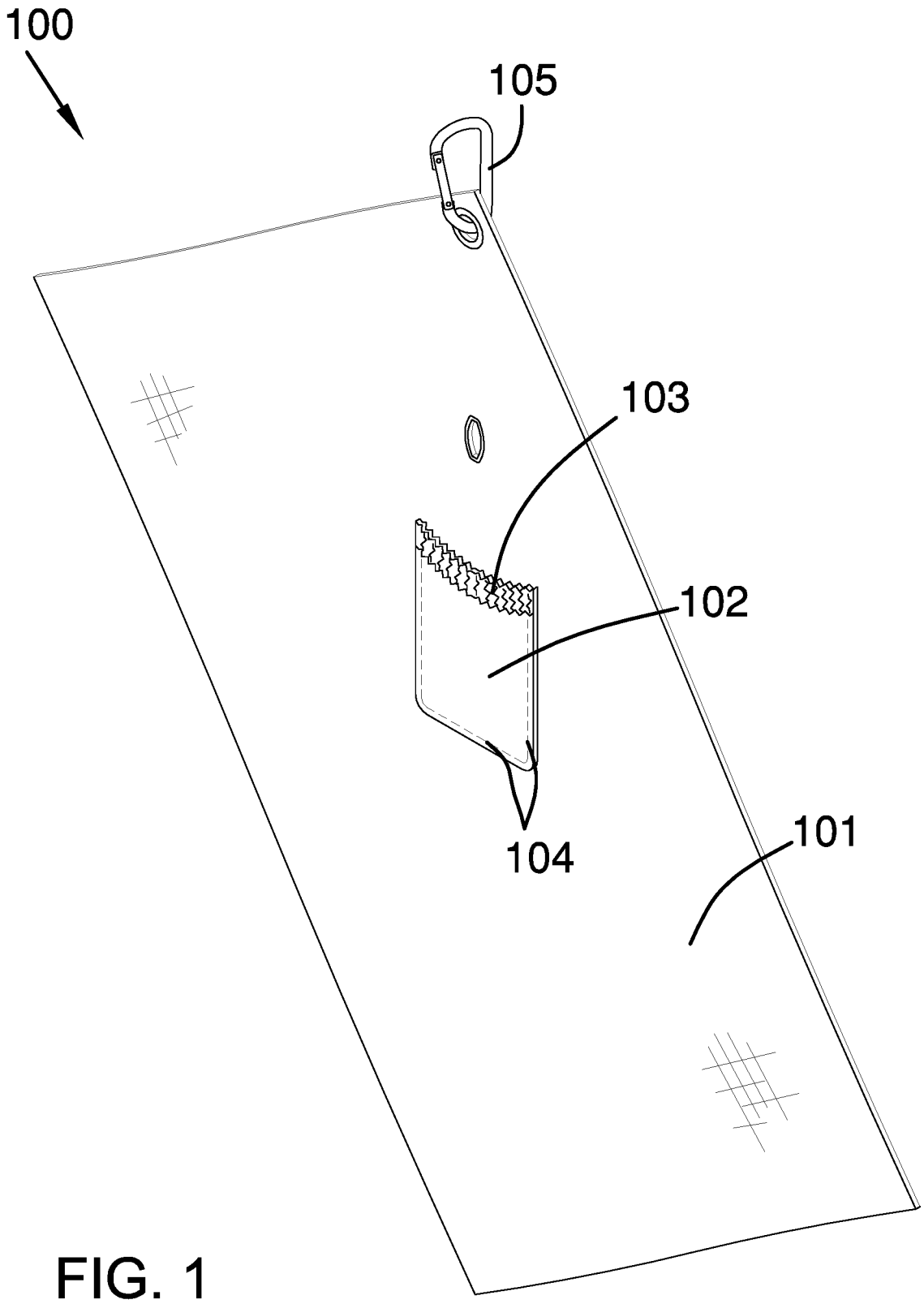
FIG. 1 is a perspective view of an embodiment of the disclosure.
Figure 2:
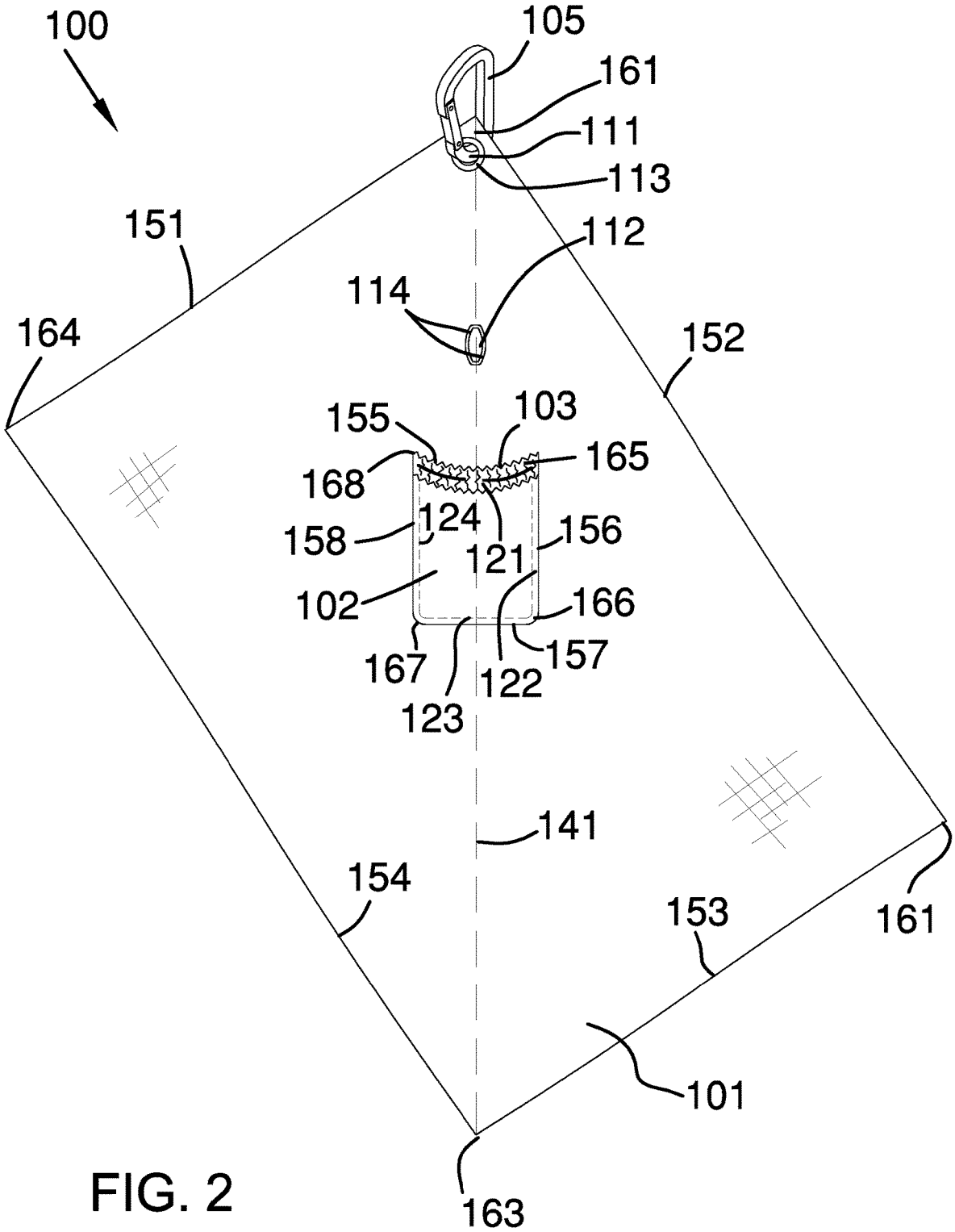
FIG. 2 is a front view of an embodiment of the disclosure.
Figure 3:
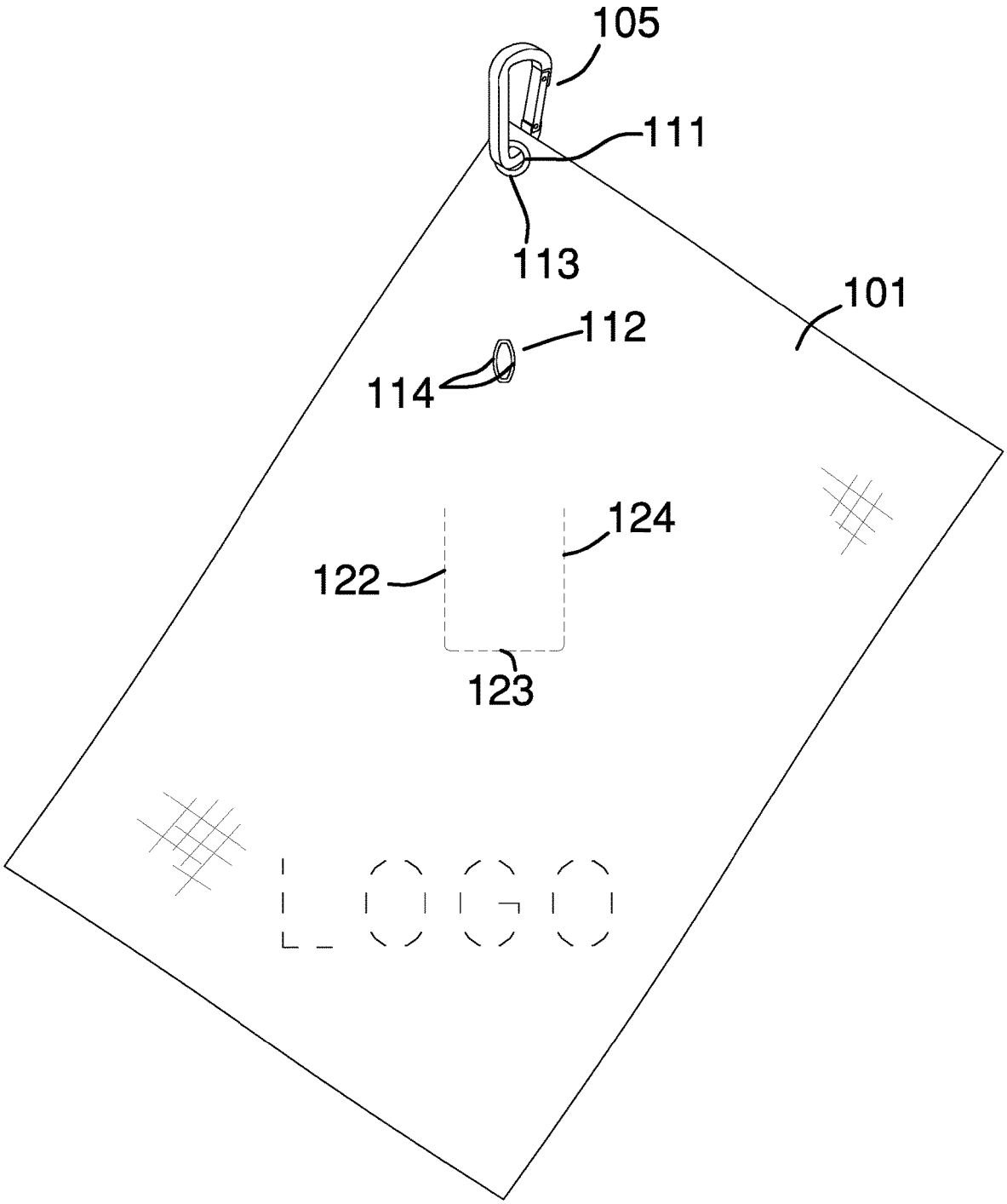
FIG. 3 is a rear view of an embodiment of the disclosure.
Figure 4:
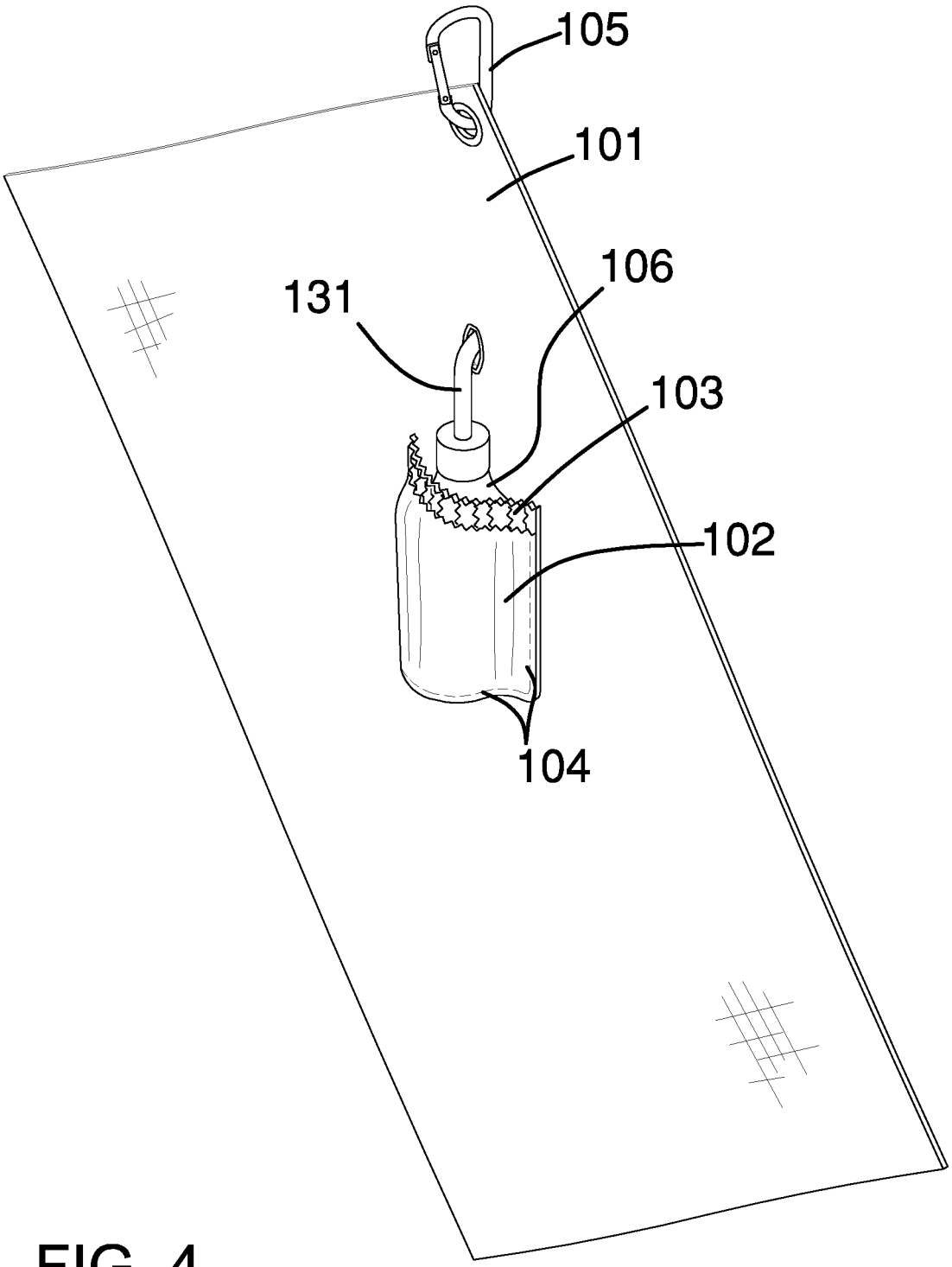
FIG. 4 is an in-use view of an embodiment of the disclosure.
Figure 5:
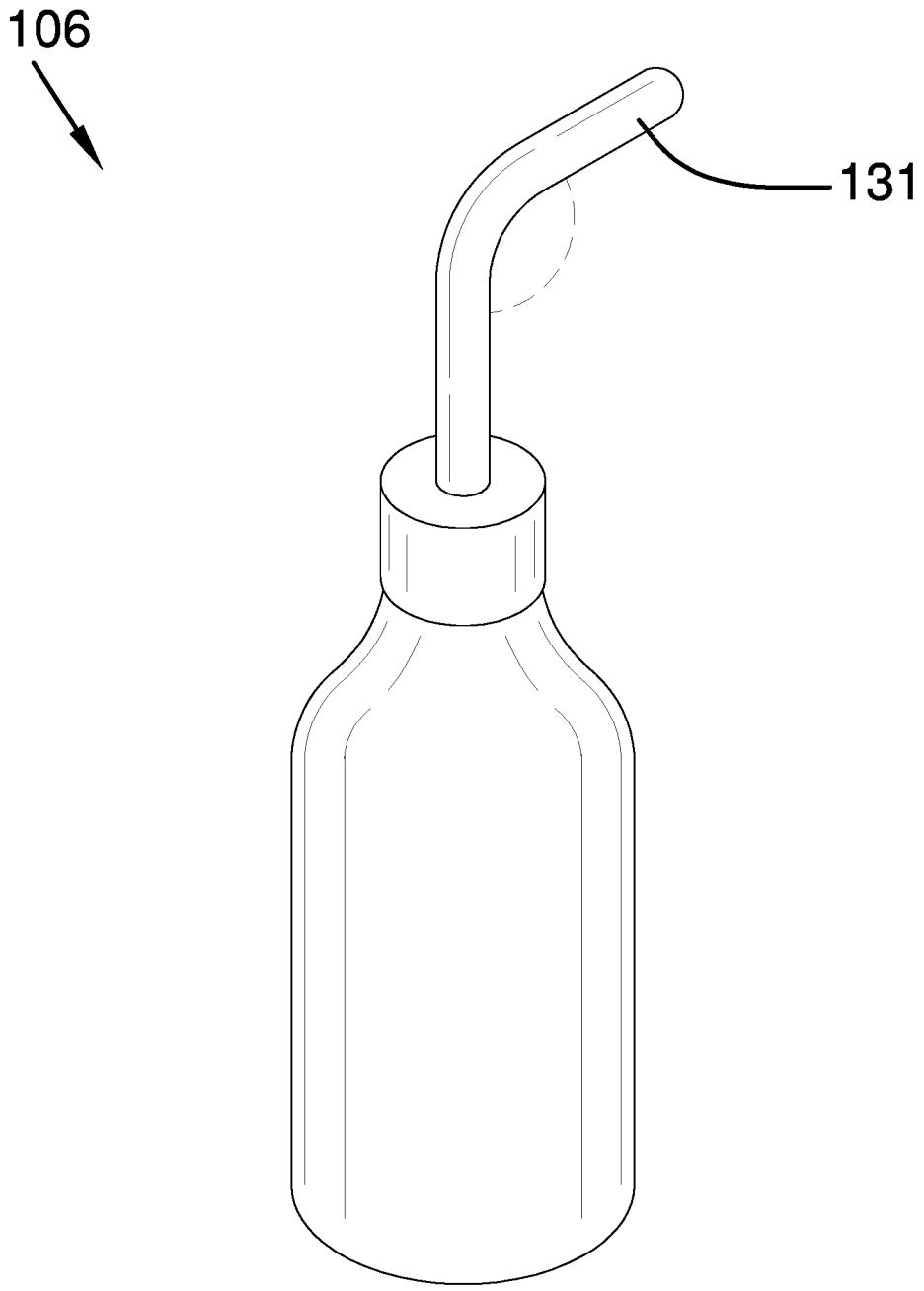
FIG. 5 is a detail view of an embodiment of the disclosure.

Detailed reference will now be made to one or more potential embodiments of the disclosure, which are illustrated in FIGS. 1 through 5.

The golf towel with liquid container 100 (hereinafter invention) is configured for use during a game of golf. The game of golf further comprises the use of a golf ball. The invention 100 is configured for use in cleaning the golf ball. The invention 100 comprises a first textile 101, a second textile 102, an elastic webbing 103, a plurality of seams 104, a carabiner 105, and a bottle 106. The second textile 102 and the elastic webbing 103 form a pocket that attaches to the first textile 101. Each of the plurality of seams 104 forms an attachment selected from the group consisting of: a) attaching the second textile 102 to the first textile 101; and, b) attaching the elastic webbing 103 to the second textile 102. The bottle 106 is contained in the pocket formed by second textile 102 and the elastic webbing 103. The carabiner 105 anchors the invention 100 to an anchor point such as a golf bag.

This disclosure assumes that the bottle 106 contains a liquid used to clean a golf ball. Those skilled in the textile and apparel arts and those skilled in the game of golf will recognize that the alternate liquids can be substituted without undue experimentation.

The first textile 101 is a textile sheeting. The first textile 101 is cut in a rectangular shape. The first textile 101 further comprises an anchor aperture 111 and a button hole 112. The first textile 101 is further defined with an alignment axis 141, a first edge 151, a second edge 152, a third edge 153, a fourth edge 154, a first corner 161, a second corner 162, a third corner 163, and a fourth corner 164.

The alignment axis 141 is a hypothetical straight line formed between the first corner 161 of the first textile 101 and the third corner 163 of the first textile 101.

The position of the first edge 151 of the first textile 101 is between the second edge 152 and the fourth edge 154 of the first textile 101. The position of the second edge 152 of the first textile 101 is between the third edge 153 and the first edge 151 of the first textile 101. The position of the third edge 153 of the first textile 101 is between the fourth edge 154 and the second edge 152 of the first textile 101. The position of the fourth edge 154 of the first textile 101 is between the first edge 151 and the third edge 153 of the first textile 101.

The first corner 161 is a vertex of the first textile 101. The first corner 161 is a right angle formed by the first edge 151 and the second edge 152 of the first textile 101. The second corner 162 is a vertex of the first textile 101. The second corner 162 is a right angle formed by the second edge 152 and the third edge 153 of the first textile 101. The third corner 163 is a vertex of the first textile 101. The third corner 163 is a right angle formed by the third edge 153 and the fourth edge 154 of the first textile 101. The fourth corner 164 is a vertex of the first textile 101. The fourth corner 164 is a right angle formed by the fourth edge 154 and the first edge 151 of the first textile 101.

The anchor aperture 111 is a circular aperture formed through the surfaces of the first textile 101. The anchor aperture 111 forms an open space that allows the carabiner 105 to anchor the invention 100 to an object. The anchor aperture 111 further comprises an anchor grommet 113.

The anchor grommet 113 is a circular eyelet that attaches to the circumference of the anchor aperture 111. The anchor grommet 113 prevents the edge that forms the circumference of the anchor aperture 111 from fraying.

The button hole 112 is a slit formed through the surfaces of the first textile 101. The button hole 112 forms an aperture through which the canted nozzle 131 of the bottle 106 inserts such that the bottle 106 will not rotate while stored in the invention 100. The button hole 112 further comprises a plurality of raw edges 114. The plurality of raw edges 114 are the raw edges formed by the slit that forms the button hole 112. The raw edge is defined elsewhere in this disclosure.

The second textile 102 is a textile sheeting. The second textile 102 is cut in a rectangular shape. The second textile 102 attaches to the first textile 101 to form a pocket that contains the bottle 106. The surface area of the second textile 102 is lesser than the surface area of the first textile 101. The second textile 102 is further defined with a fifth edge 155, a sixth edge 156, a seventh edge 157, an eighth edge 158, a fifth corner 165, a sixth corner 166, a seventh corner 167, and an eighth corner 168.

The position of the fifth edge 155 of the second textile 102 is between the sixth edge 156 and the eighth edge 158 of the second textile 102. The position of the sixth edge 156 of the second textile 102 is between the seventh edge 157 and the fifth edge 155 of the second textile 102. The position of the seventh edge 157 of the second textile 102 is between the eighth edge 158 and the sixth edge 156 of the second textile 102. The position of the eighth edge 158 of the second textile 102 is between the fifth edge 155 and the seventh edge 157 of the second textile 102.

The fifth corner 165 is a vertex of the second textile 102. The fifth corner 165 is a right angle formed by the fifth edge 155 and the sixth edge 156 of the second textile 102. The sixth corner 166 is a vertex of the second textile 102. The sixth corner 166 is a right angle formed by the sixth edge 156 and the seventh edge 157 of the second textile 102. The seventh corner 167 is a vertex of the second textile 102. The seventh corner 167 is a right angle formed by the seventh edge 157 and the eighth edge 158 of the second textile 102. The eighth corner 168 is a vertex of the second textile 102. The eighth corner 168 is a right angle formed by the eighth edge 158 and the fifth edge 155 of the second textile 102

The elastic webbing 103 is an elastic textile webbing. The span of the length of the major axis of the elastic webbing 103 is lesser than the span of the length of the fifth edge 155 of the second textile 102.

The elastic webbing 103 acts as a spring. Specifically, when a force is applied to both ends of the elastic webbing 103 in a direction parallel to the major axis of the elastic webbing 103, the applied force elongates the span of the end to end length the elastic webbing 103 in the direction parallel to the center axis of the elastic webbing 103. The elasticity of the elastic webbing 103 creates a force that opposes the displacement created by the applied force. The elasticity of the elastic webbing 103 returns the elastic webbing 103 to return to its relaxed shape.

The elastic webbing 103 attaches to the fifth edge 155 of the second textile 102 while the elastic webbing 103 is under tension. In this circumstance, the elastic webbing 103 pulls the fifth edge 155 of the second textile 102 with it as the elastic webbing 103 returns to its relaxed shape after attachment. This allows the fifth edge 155 to subsequently stretch when the bottle 106 inserts into the pocket formed by the second textile 102 and the elastic webbing 103. When the elongated elastic webbing 103 is wrapped around the bottle 106 after insertion into the pocket, the bottle 106 prevents the elastic webbing 103 from returning to its relaxed shape. In this circumstance, the elastic webbing 103 will apply a force projecting radially away from the center axis of the elastic webbing 103 against the bottle 106 in a manner that binds the elastic webbing 103 to the bottle 106.

Each of the plurality of seams 104 is a sewn seam. Each of the plurality of seams 104 forms an attachment selected from the group consisting of: a) connecting the elastic webbing 103 to the fifth edge 155 of the second textile 102; and, b) connecting an edge selected from the group consisting of the sixth edge 156 of the second textile 102, the seventh edge 157 of the second textile 102 and the eighth edge 158 of the second textile 102 to the first textile 101. The plurality of seams 104 comprises a first seam 121, a second seam 122, a third seam 123, and a fourth seam 124. The first seam 121 is a sewn seam. The second seam 122 is a sewn seam. The third seam 123 is a sewn seam. The fourth seam 124 is a sewn seam.

The carabiner 105 is a fastening structure used to anchor the invention 100 to an object. The carabiner 105 is defined elsewhere in this disclosure.

The bottle 106 is a container configured for use with a liquid. The pocket formed by attaching the second textile 102 and the elastic webbing 103 to the first textile 101 stores the bottle 106. The bottle 106 is defined in greater detail elsewhere in this disclosure. The bottle 106 further comprises a canted nozzle 131. The canted nozzle 131 is a nozzle that attaches to the bottle 106. The liquid stored in the bottle 106 is discharged through the canted nozzle 131. The canted nozzle 131 is a tubular structure. The canted nozzle 131 has a non-Euclidean shape that forms a cant within the tube that forms the canted nozzle 131. The canted nozzle 131 is sized to insert through the button hole 112.

The following five paragraphs describe the assembly of the invention 100.

The second textile 102 attaches to the first textile 101 such that the center of the second textile 102 overlays the center of the first textile 101. The second textile 102 attaches to the first textile 101 such that the major axis of the second textile 102 aligns with the alignment axis 141 of the first textile 101.

The anchor aperture 111 is formed in the first textile 101 such that the center of the anchor aperture 111 lays on the alignment axis 141 of the first textile 101. The position of the anchor aperture 111 on the first textile 101 is such that the anchor aperture 111 is between the first corner 161 and the center of the first textile 101.

The button hole 112 is formed in the first textile 101 such that the plurality of raw edges 114 of the button hole 112 align with the alignment axis 141 of the first textile 101. The position of the button hole 112 on the first textile 101 is such that the button hole 112 is between the anchor aperture 111 and the center of the first textile 101. The anchor grommet 113 attaches to the anchor aperture 111 such that the center of the anchor grommet 113 lays on the alignment axis 141 of the first textile 101.

The first seam 121 attaches the elastic webbing 103 to the fifth edge 155 of the second textile 102. The first seam 121 attaches the elastic webbing 103 to the fifth edge 155 while the elastic webbing 103 is under tension. The second seam 122 attaches the sixth edge 156 of the second textile 102 to the face of the first textile 101. The third seam 123 attaches the seventh edge 157 of the second textile 102 to the face of the first textile 101. The fourth seam 124 attaches the eighth edge 158 of the second textile 102 to the face of the first textile 101.

The bottle 106 inserts into the pocket formed between the second textile 102 and the first textile 101 by sliding between the elastic webbing 103 and the first textile 101.

The following definitions were used in this disclosure:

Absorbent: As used in this disclosure, absorbent is an adjective that refers to a material that can soak up a liquid such as water.

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Anchor: As used in this disclosure, anchor means to hold an object firmly or securely.

Anchor Point: As used in this disclosure, an anchor point is a location to which a first object can be securely attached to a second object.

Aperture: As used in this disclosure, an aperture is a prism-shaped negative space that is formed completely through a structure or the surface of a structure.

Bottle: As used in this disclosure, a bottle is a container used for the storage of fluids. Access to the interior of a bottle is gained through the neck of the bottle. The neck is an elongated tube that forms an aperture through which fluids can be introduced and removed from the bottle.

Cant: As used in this disclosure, a cant is an angular deviation from one or more reference lines (or planes) such as a vertical line (or plane) or a horizontal line (or plane).

Carabiner: As used in this disclosure, a carabiner is coupling link that is usually formed as an oblong metal ring with one spring hinged side that is used to open and close the ring. Synonyms for carabiner include D-link.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Elastic: As used in this disclosure, an elastic is a material or object that deforms when a force is applied to it and that is able to return to its relaxed shape after the force is removed. A material that exhibits these qualities is also referred to as an elastomeric material. A material that does not exhibit these qualities is referred to as inelastic or an inelastic material.

Elastic Webbing: As used in this disclosure, an elastic webbing is a webbing that contains elastic yarns as some of the yarns that make up the webbing. An elastic webbing is constructed such that the elastic webbing will stretch when a force is applied and will return to its original shape when after the force is removed.

Grommet: As used in this disclosure, a grommet is an eyelet placed in a hole in a textile, sheet, or panel that protects a rope hook or cable passed through it and to protect the textile, sheet, or panel from being torn.

Major and Minor Axes: As used in this disclosure, the major and minor axes refer to a pair of perpendicular axes that are defined within a structure. The length of the major axis is always greater than or equal to the length of the minor axis. The major axis is always the longest diameter of the structure. The major and minor axes intersect at the center of the structure. The major axis is always parallel to the longest edge of a rectangular structure.

Non-Euclidean Prism: As used in this disclosure, a non-Euclidean prism is a prism structure wherein the center axis of the prism lies on a non-Euclidean plane.

Nozzle: As used in this disclosure, a nozzle is a device that receives fluid under pressure and releases the fluid in a controlled manner into an environment.

Pocket: As used in this disclosure, a pocket is a small pouch or storage space that is formed into an object. Pockets are often formed by joining a second textile or a second sheeting to a first textile or a first sheeting, respectively, by sewing or heat sealing respectively. Methods to form pockets are well-known and documented in the textile and apparel arts.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Raw Edge: As used in this disclosure, a raw edge refers to one of two edges that are formed when a slit is cut through the face of the sheeting. The one or more ends of the slit are called the termination points.

Relaxed Shape: As used in this disclosure, a structure is considered to be in its relaxed state when no shear, strain, or torsional forces are being applied to the structure.

Seam: As used in this disclosure, a seam is a joining of: 1) a first textile to a second textile; 2) a first sheeting to a second sheeting; or, 3) a first textile to a first sheeting. Potential methods to form seams include, but are not limited to, a sewn seam, a heat bonded seam, an ultrasonically bonded seam, a laser seam, or a seam formed using an adhesive.

Sewn Seam: As used in this disclosure, a sewn seam a method of attaching two or more layers of textile, leather, or other material through the use of a thread, a yarn, or a cord that is repeatedly inserted and looped through the two or more layers of textile, leather, or other material.

Slit: As used in this disclosure, a slit is a long narrow cut or opening that is formed in or through an object.

Textile: As used in this disclosure, a textile is a material that is woven, knitted, braided or felted. Synonyms in common usage for this definition include fabric and cloth.

Tube: As used in this disclosure, the term tube is used to describe a rigid hollow prism-shaped device with two open ends. While tubes that are suitable for use in this disclosure are often used to transport or conveys fluids or gases, the purpose of the tubes in this disclosure are structural. In this disclosure, the terms inner dimension and outer dimension of a tube are used as they would be used by those skilled in the plumbing arts.

Webbing: As used in this disclosure, a webbing is strong, close woven or knitted fabric that is used for straps or belting. As used in this disclosure, webbing is a fully formed material that is only cut to length for use. Webbing is not formed by cutting broader materials into strips. Webbings have tensile strength but are too flexible to provide compressive strength and are not suitable for use in pushing objects. The two surfaces of a webbing with the greatest surface area are called the faces of the webbing.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. The golf towel with liquid container comprises a first textile, a second textile, an elastic webbing, a plurality of seams, a carabiner, and a bottle;

wherein the second textile and the elastic webbing form a pocket that attaches to the first textile;

wherein each of the plurality of seams forms an attachment selected from the group consisting of: a) attaching the second textile to the first textile; and, b) attaching the elastic webbing to the second textile;

wherein the bottle is contained in the pocket formed by second textile and the elastic webbing;

wherein the carabiner anchors the golf towel with liquid container to an anchor point;

wherein the first textile further comprises an anchor aperture and a button hole;

wherein the anchor aperture is a circular aperture formed through the surfaces of the first textile;

wherein the anchor aperture forms an open space that allows the carabiner to anchor the golf towel with liquid container to an object;

wherein the button hole is a slit formed through the surfaces of the first textile;

wherein the button hole forms an aperture.

2. The golf towel with liquid container according to claim 1 wherein the first textile is a textile sheeting;

wherein the first textile is further defined with an alignment axis, a first edge, a second edge, a third edge, a fourth edge, a first corner, a second corner, a third corner, and a fourth corner;

wherein the alignment axis is a hypothetical straight line formed between the first corner of the first textile and the third corner of the first textile;

wherein the first corner is a vertex of the first textile;

wherein the second corner is a vertex of the first textile;

wherein the third corner is a vertex of the first textile;

wherein the fourth corner is a vertex of the first textile.

3. The golf towel with liquid container according to claim 2 wherein the first corner is a right angle formed by the first edge and the second edge of the first textile;

wherein the second corner is a right angle formed by the second edge and the third edge of the first textile;

wherein the third corner is a right angle formed by the third edge and the fourth edge of the first textile;

wherein the fourth corner is a right angle formed by the fourth edge and the first edge of the first textile.

4. The golf towel with liquid container according to claim 3 wherein the second textile is a textile sheeting;

wherein the second textile attaches to the first textile to form the pocket;

wherein the second textile is further defined with a fifth edge, a sixth edge, a seventh edge, an eighth edge, a fifth corner, a sixth corner, a seventh corner, and an eighth corner;

wherein the fifth corner is a vertex of the second textile;

wherein the sixth corner is a vertex of the second textile;

wherein the seventh corner is a vertex of the second textile;

wherein the eighth corner is a vertex of the second textile.

5. The golf towel with liquid container according to claim 4 the elastic webbing is an elastic textile webbing.

6. The golf towel with liquid container according to claim 5 wherein the span of the length of the major axis of the elastic webbing is lesser than the span of the length of the fifth edge of the second textile.

7. The golf towel with liquid container according to claim 6 wherein each of the plurality of seams is a sewn seam;

wherein each of the plurality of seams forms an attachment selected from the group consisting of: a) connecting the elastic webbing to the fifth edge of the second textile; and, b) connecting an edge selected from the group consisting of the sixth edge of the second textile, the seventh edge of the second textile and the eighth edge of the second textile to the first textile.

8. The golf towel with liquid container according to claim 7 wherein the carabiner is a fastening structure used to anchor the golf towel with liquid container to an object.

9. The golf towel with liquid container according to claim 8 wherein the bottle is a container configured for use with a liquid;

wherein the pocket formed by attaching the second textile and the elastic webbing to the first textile stores the bottle.

10. The golf towel with liquid container according to claim 9 wherein the anchor aperture further comprises an anchor grommet;

wherein the anchor grommet is a circular eyelet that attaches to the circumference of the anchor aperture;

wherein the anchor grommet prevents the edge that forms the circumference of the anchor aperture from fraying.

11. The golf towel with liquid container according to claim 10 wherein the button hole further comprises a plurality of raw edges;

wherein the plurality of raw edges are the raw edges formed by the slit that forms the button hole.

12. The golf towel with liquid container according to claim 11 wherein the surface area of the second textile is lesser than the surface area of the first textile.

13. The golf towel with liquid container according to claim 12 wherein the fifth corner is a right angle formed by the fifth edge and the sixth edge of the second textile;

wherein the sixth corner is a right angle formed by the sixth edge and the seventh edge of the second textile;

wherein the seventh corner is a right angle formed by the seventh edge and the eighth edge of the second textile;

wherein the eighth corner is a right angle formed by the eighth edge and the fifth edge of the second textile.

14. The golf towel with liquid container according to claim 13 wherein the plurality of seams comprises a first seam, a second seam, a third seam, and a fourth seam;

wherein the first seam is a sewn seam;

wherein the second seam is a sewn seam;

wherein the third seam is a sewn seam;

wherein the fourth seam is a sewn seam.

15. The golf towel with liquid container according to claim 14 wherein the bottle further comprises a canted nozzle;

wherein the canted nozzle is a nozzle that attaches to the bottle;

wherein the liquid stored in the bottle is discharged through the canted nozzle;

wherein the canted nozzle is a tubular structure;

wherein the canted nozzle has a non-Euclidean shape that forms a cant within the tube that forms the canted nozzle.

16. The golf towel with liquid container according to claim 15 wherein the canted nozzle is sized to insert through the button hole.

17. The golf towel with liquid container according to claim 16 wherein the second textile attaches to the first textile such that the center of the second textile overlays the center of the first textile;

wherein the second textile attaches to the first textile such that the major axis of the second textile aligns with the alignment axis of the first textile.

18. The golf towel with liquid container according to claim 17 wherein the anchor aperture is formed in the first textile such that the center of the anchor aperture lays on the alignment axis of the first textile;

wherein the position of the anchor aperture on the first textile is such that the anchor aperture is between the first corner and the center of the first textile;

wherein the button hole is formed in the first textile such that the plurality of raw edges of the button hole align with the alignment axis of the first textile;

wherein the position of the button hole on the first textile is such that the button hole is between the anchor aperture and the center of the first textile;

wherein the anchor grommet attaches to the anchor aperture such that the center of the anchor grommet lays on the alignment axis of the first textile.

19. The golf towel with liquid container according to claim 18 wherein the first seam attaches the elastic webbing to the fifth edge of the second textile;

wherein the second seam attaches the sixth edge of the second textile to the face of the first textile;

wherein the third seam attaches the seventh edge of the second textile to the face of the first textile;

wherein the fourth seam attaches the eighth edge of the second textile to the face of the first textile.

* * * * *